United States Patent [19]

Gregg

[11] Patent Number: 5,059,145

[45] Date of Patent: Oct. 22, 1991

[54] PADDLE SUSPENSION DEVICE

[76] Inventor: Peter Gregg, Box 141, Heriot Bay, B.C., Canada, V0P 1H0

[21] Appl. No.: 399,745

[22] Filed: Aug. 28, 1989

[51] Int. Cl.[5] ..... B63H 16/06

[52] U.S. Cl. ..... 440/104; 114/347

[58] Field of Search ..... 440/101, 104–108; 416/70 R, 74; 114/343, 347

[56] References Cited

U.S. PATENT DOCUMENTS

| | | | |
|---|---|---|---|
| 88,013 | 3/1869 | Connor | 440/104 |
| 2,083,004 | 6/1937 | Clark | 440/104 |
| 3,064,285 | 11/1962 | Ingal | 440/104 |

FOREIGN PATENT DOCUMENTS

| | | | |
|---|---|---|---|
| 3415483 | 10/1985 | Fed. Rep. of Germany | 440/101 |
| 65872 | 1/1865 | France | 440/104 |
| 94005 | 5/1969 | France | 440/104 |

OTHER PUBLICATIONS

"Sea Kayaker" Magazine, Fall 1988, vol. 5, No. 2, p. 67.

"Sea Kayaker" Magazine, Winter 1988–89, vol. 5, No. 3.

1989 Catalog for "Ecomarine Ocean Kayak Centre", 1668 Duranleau Street, Granville Island, Vancouver, B.C., Canada, V6H 3S4, p. 12.

"The Northerner", La Ronge, Saskatchewan, Jul. 26, 1989 issue.

*Primary Examiner*—Ed Swinehart

*Attorney, Agent, or Firm*—Barrigar & Oyen

[57] ABSTRACT

This invention relates to a device for suspending a double-ended paddle which is used to propel a small water craft. The device can be readily disassembled and stored and has particular application to kayaks. In the preferred embodiment of the invention the paddle is supported by an elastic member attached at its midpoint. The elastic member depends from a freely swinging overhead boom which projects from a mast mounted to the water craft in front of the paddler. The paddle location and paddle lifting force can be adjusted.

13 Claims, 2 Drawing Sheets

PADDLE SUSPENSION DEVICE

FIELD OF THE INVENTION

This invention relates to a novel device for suspending a double-ended paddle which is used for propelling a water craft such as a kayak.

BACKGROUND OF THE INVENTION

Double-ended paddles are commonly used by paddlers for propelling the water craft, most usually kayaks, over the water surface. The paddler supports the paddle in front of him or her and generally makes alternating water strokes with the left and right ends of the paddle. On a long trip, a paddler can easily become fatigued from the exertion involved in paddling, supporting the weight of his or her arms and supporting the weight of the paddle. The present invention is designed to reduce the strain on the paddler by supporting the weight of the paddle and at least part of the weight of the paddlers arms and shoulders, and by assisting the paddler in the paddle lift component of the paddle stroke.

SUMMARY OF THE INVENTION

The device consists of a support means, such as a framework, which is attached to a watercraft and from which a paddle is suspended at its mid-point. The framework can comprise an overhead boom which, in turn, has a free swinging attachment to a vertically and centrally mounted mast forward of the paddler. The paddle is attached to an elastic member which depends from the boom. The length of elastic member depending from the boom as well as the point at which the elastic member is supported by the boom may be adjustable. In its broadest form, this invention relates to a device for suspending a double-ended boat propelling paddle in a desired paddle position. The device comprises: support means associated with a boat and extending to a position above the desired paddle position; flexible paddle suspension means depending from said support means to a point near said desired paddle position; and means for connecting said flexible paddle suspension means near the midpoint of said paddle.

BRIEF DESCRIPTION OF THE DRAWINGS

Reference is now made to the accompanying drawings which depict specific embodiments of the invention, but which should not be construed as restricting the spirit or scope of the invention in any way.

DETAILED DESCRIPTION OF A SPECIFIC EMBODIMENT OF THE INVENTION

Figure 1:
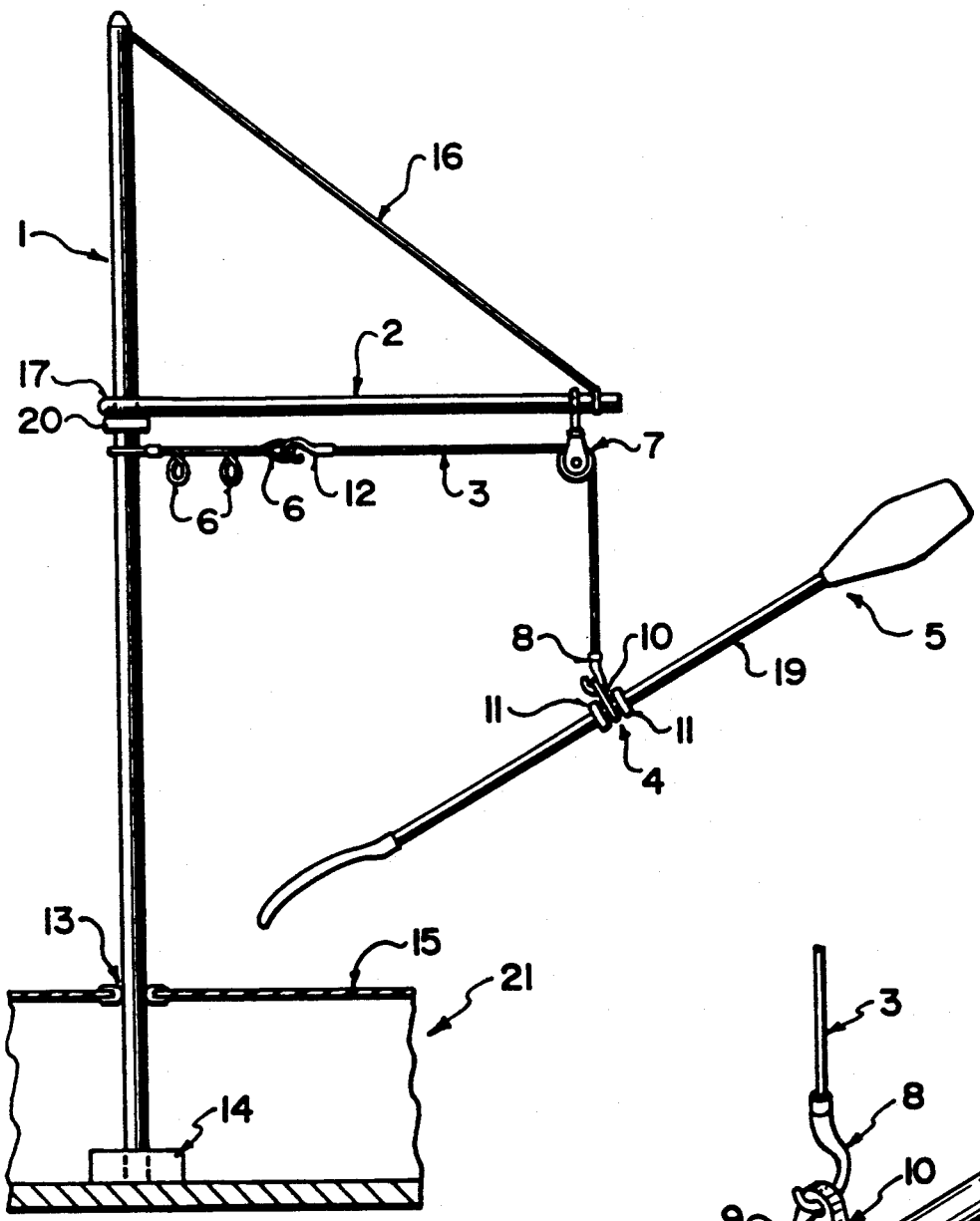
FIG. 1 is a side view of the paddle suspension device.

As shown in FIG. 1, an upright mast 1 is supported in a kayak hull 21 (only a section of which is shown). The lower end of the mast 1 passes through a hole 13 in the deck 15 of the kayak 21 and seats in receptacle 14. The mast 1 is removable and may be hinged and folded for easier transportation (not shown). Boom 2 is attached to the mast 1 by coupling 17 and is supported by guy-wire 16. Coupling 17 is prevented from sliding down the mast 1 by collar 20. Boom 2 is free to swing relative to mast 1 about coupling 17. The boom 2 is long enough to reach from the mast 1 to a point in front of the paddler (not shown) above the desired paddle position. The desired paddle position may vary from paddler to paddler. Shock cord 3 (constructed of an elastic material) passes along under boom 2 and through pulley 7. Shock cord 3 is terminated at its upper end by hook 12 which is hooked into one of adjustment loops 6. The length of the shock cord depending from pulley 7 to the slip ring 10, and consequently the tension of the shock cord when it is stretched, can be adjusted by hooking hook 12 to a different one of adjustment loops 6. The position at which shock cord 3 depends from boom 2 can be adjusted by moving pulley 7 along boom 2. Proper adjustment of the paddle suspension device is realized when the paddler rests his hands on the paddle at eye level and it drops to a proper paddling position while supporting most of the weight of his or her hands and arms and all of the weight of the paddle.

Figure 2:
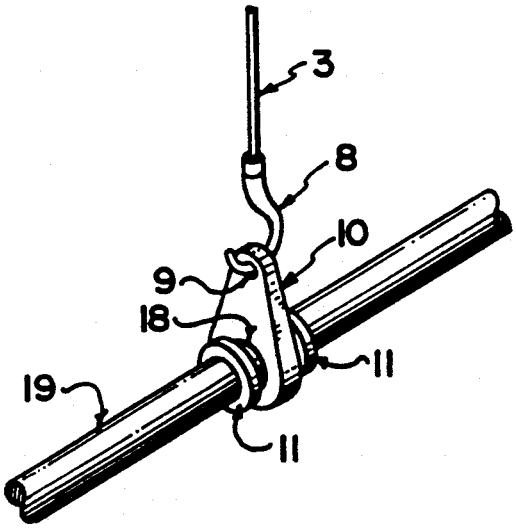
FIG. 2 is an enlarged view of a means for connecting the device to a paddle.

As is depicted in detail in FIG. 2, the shaft 19 of paddle 5 passes through a lower hole 18 in slip ring 10. Hole 18 is large enough to allow rotation of paddle shaft 19 relative to slip-ring 10. Slip ring 10 is situate between left and right positioning rings 11 which are fit tightly to the paddle shaft 19 on either side of mid-point 4 (see FIG. 1). Positioning rings 11 have an external diameter too large to fit through hole 18 in slip-ring 10 and thus maintain slip-ring 10 near to the mid-point 4 of paddle 5. The clearance between slip-ring 10 and positioning rings 11 is sufficient to allow rotation of paddle shaft 19 relative to slip-ring 10 as aforementioned.

Shock cord 3 is terminated at its lower end by hook 8. This allows paddle 5 to be releasably connected to shock cord 3 by hooking hook 8 through upper hole 9 in slip-ring 10. If the paddler wishes to put his paddle down, he or she unhooks the hook 8 from hoe 9. Further disassembly for storage is facilitated as well and may also be required where whitewater is encountered.

The paddle suspension device relieves the paddler of the paddle lift component of his paddle stroke, carries the weight of the paddle, and partially supports the weight of the paddler's hands and arms. This is an advantage especially on long trips where supporting weight of the paddle for extended periods of time can lead to the paddler becoming fatigued.

Figure 3:
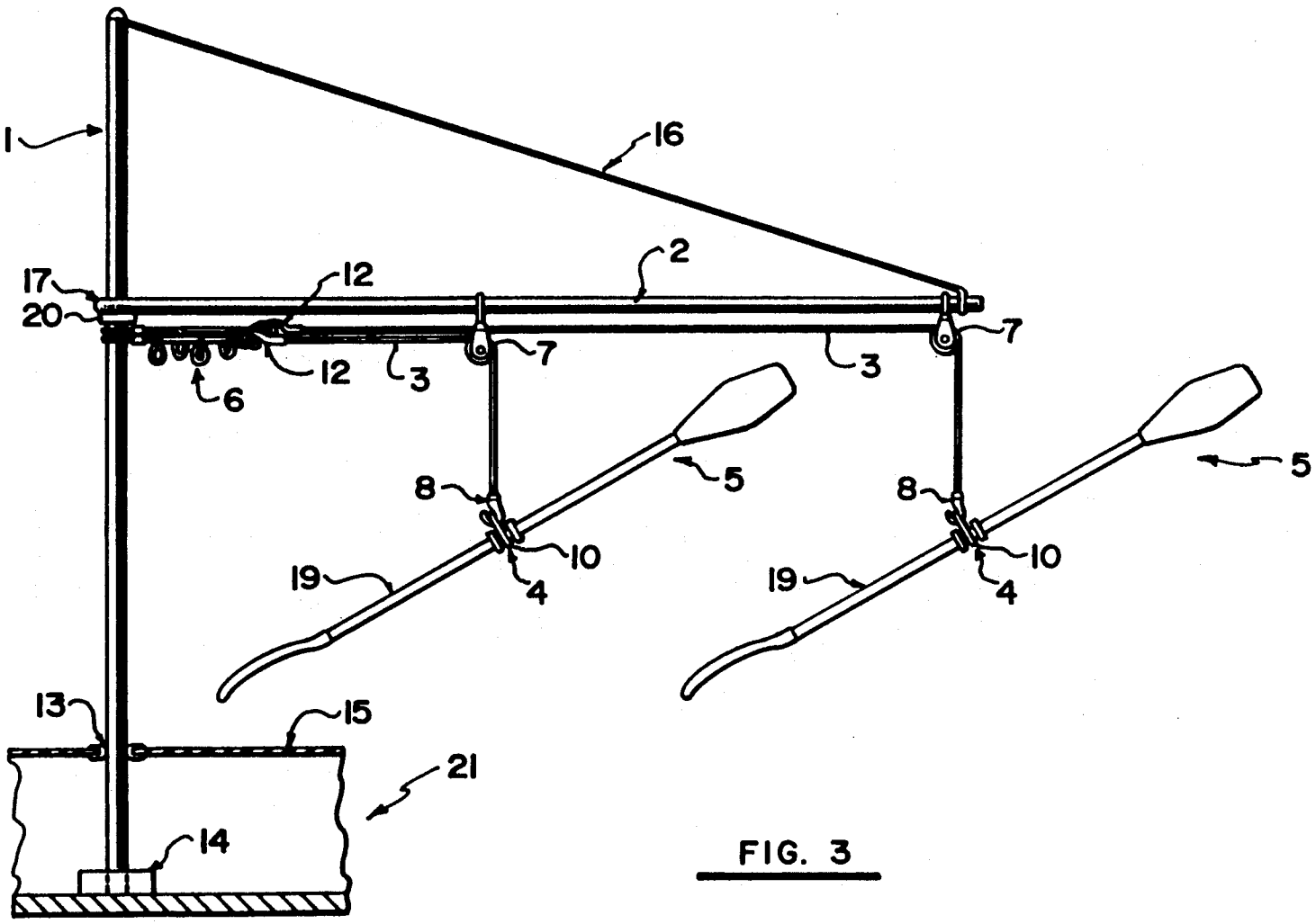
FIG. 3 is a side view of the paddle suspension device showing the tandem suspension system.

The foregoing description has been directed to a device for supporting a single paddle. Modifications for supporting two paddles for use with a two-seater kayak are readily apparent since they involve the same inventive concept. As shown in FIG. 3, the most unchanged, a longer boom is used and single suspension cord 3 may be replaced by two separate shock cords to create a tandem suspension system.

As will be apparent to those skilled in the art, in the light of the foregoing disclosure, many modifications and alterations are possible in the practise of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A device for suspending first and second double-ended boat propelling paddles in respective first and second desired paddle positions relative to a boat, said device comprising:

(a) an upwardly projecting mast removably connectable to said boat;

(b) at least one boom projecting outwardly from said mast to a position above said first and second desired paddle positions respectively;

(c) first and second paddle suspension means depending from said boom to points near each of said desired paddle positions;

(d) means for connecting said first paddle suspension means to said first paddle near the midpoint of said first paddle; and (e) means for connecting said second paddle suspension means to said second paddle near the midpoint of said second paddle.

2. The device of claim 1 wherein said first and second suspension means comprise flexible resilient cords.

3. The device of claim 1 wherein each of said paddle connecting means permits rotation of said first or second paddle about its axis.

4. The device of claim 1 wherein said boom extends in a substantially horizontal plane relative to said mast.

5. The device of claim 4 wherein said boom is rotatably coupled to said mast to enable said boom to swing freely from side to side relative to the centerline of said boat.

6. The device of claim 2 wherein said suspension means further comprises a pulley movable along the axis of said boom for supporting said flexible resilient cord.

7. The device of claim 2 wherein each of said paddle connection means permits rotation of said first or second paddle about its axis.

8. A device for suspending first and second double-ended boat propelling paddles in respect of first and second desired paddle positions relative to a boat having an upwardly projecting mast, said device comprising:

(a) at least one boom connectable to said mast and projecting outwardly therefrom to a position above said first and second desired paddle positions respectively;

(b) first and second paddle suspension means depending from said boom to points near each of said desired paddle positions;

(c) means for connecting said first paddle suspension means to said first paddle near the midpoint of said first paddle; and (d) means for connecting said second paddle suspension means to said second paddle near the midpoint of said second paddle.

9. The device of claim 8 wherein said boom extends in a substantially horizontal plane relative to said mast.

10. The device of claim 8 wherein said boom is rotatably connectable to said mast to enable said boom to swing freely from side to side relative to the centerline of said boat.

11. The device of claim 8 wherein said suspension means comprises a flexible resilient cord.

12. The device of claim 11 wherein said suspension means further comprises a pulley movable along the axis of said boom for supporting said flexible resilient cord.

13. The device of claim 8 wherein said paddle connecting means permits rotation of said paddle about its axis.

* * * * *

UNITED STATES PATENT AND TRADEMARK OFFICE

CERTIFICATE OF CORRECTION

PATENT NO. : 5,059,145

DATED : 22 October, 1991

INVENTOR(S) : Peter Gregg

It is certified that error appears in the above-identified patent and that said Letters Patent is hereby corrected as shown below:

Column 2, line 37, change "hoe" to --hole--.

Column 2, line 51, change "most" to --may be--.

Signed and Sealed this

Thirtieth Day of November, 1993

*Attest:*

*Attesting Officer*

BRUCE LEHMAN

*Commissioner of Patents and Trademarks*